US009896910B2

(12) United States Patent
Donderici et al.

(10) Patent No.: US 9,896,910 B2
(45) **Date of Patent: *Feb. 20, 2018**

(54) FERROFLUID TOOL FOR ISOLATION OF OBJECTS IN A WELLBORE

(71) Applicant: HALLIBURTON ENERGY SERVICES, INC., Houston, TX (US)

(72) Inventors: Burkay Donderici, Houston, TX (US); Baris Guner, Kingwood, TX (US); George David Goodman, Houston, TX (US); Wesley Neil Ludwig, Fort Worth, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 317 days.

This patent is subject to a terminal disclaimer.

(21) Appl. No.: 14/423,562

(22) PCT Filed: Dec. 30, 2013

(86) PCT No.: PCT/US2013/078256

§ 371 (c)(1),
(2) Date: Feb. 24, 2015

(87) PCT Pub. No.: WO2015/102566

PCT Pub. Date: Jul. 9, 2015

(65) Prior Publication Data

US 2016/0040507 A1 Feb. 11, 2016

(51) Int. Cl.
*E21B 41/00* (2006.01)
*E21B 33/12* (2006.01)

(52) U.S. Cl.
CPC ..... *E21B 41/00* (2013.01); *E21B 33/12* (2013.01)

(58) Field of Classification Search
CPC ..... E21B 33/10; E21B 33/12
See application file for complete search history.

(56) References Cited

U.S. PATENT DOCUMENTS 3,984,918 A 10/1976 Chaney
4,035,718 A 7/1977 Chandler
4,350,955 A 9/1982 Jackson et al.
(Continued)

FOREIGN PATENT DOCUMENTS

GB 2222680 3/1990
PL 397294 6/2013
(Continued)

OTHER PUBLICATIONS

Dickstein et al., Labyrinthine Pattern Formation in Magnetic Fluids, Science, New Series, vol. 261, No. 5124, Aug. 20, 1993, pp. 1012-1015.

(Continued)

*Primary Examiner* — Jennifer H Gay
(74) *Attorney, Agent, or Firm* — Kilpatrick Townsend & Stockton LLP

(57) ABSTRACT

A tool for isolating objects in a wellbore using ferrofluids in a downhole system is provided. The downhole system can include a tool body, a source of ferrofluid, and a magnet. The magnet can magnetically couple with the ferrofluid from the source for arranging the ferrofluid adjacent to the tool body for isolating an object positioned in a wellbore from effects of fluids present in the wellbore.

19 Claims, 8 Drawing Sheets

(56) References Cited

U.S. PATENT DOCUMENTS 4,356,098 A 10/1982 Chagnon
4,424,974 A 1/1984 Mitsuya et al.
4,444,398 A 4/1984 Black et al.
4,502,700 A 3/1985 Gowda et al.
4,526,379 A 7/1985 Raj
4,604,222 A 8/1986 Borduz et al.
4,604,229 A 8/1986 Raj et al.
4,630,243 A 12/1986 MacLeod
4,630,943 A 12/1986 Stahl et al.
4,691,774 A 9/1987 Nelson
4,802,534 A 2/1989 Larson et al.
4,845,988 A 7/1989 Russell et al.
4,865,334 A 9/1989 Raj et al.
4,991,438 A 2/1991 Evans
5,007,513 A 4/1991 Carlson
5,092,611 A 3/1992 Ehmsen et al.
5,429,000 A 7/1995 Raj et al.
5,452,520 A 9/1995 Raj et al.
5,474,302 A 12/1995 Black et al.
5,475,309 A 12/1995 Hong et al.
5,780,741 A 7/1998 Raj
5,850,624 A 12/1998 Gard et al.
6,216,787 B1 4/2001 Ruttley
6,250,848 B1 6/2001 Moridis et al.
6,257,356 B1 7/2001 Wassell
6,290,894 B1 9/2001 Raj et al.
6,305,694 B1 10/2001 Yamazumi et al.
6,681,849 B2 1/2004 Goodson, Jr.
6,817,415 B2 11/2004 Orban et al.
7,021,406 B2 4/2006 Zitha
7,032,670 B2 4/2006 Zitha
7,063,146 B2 6/2006 Schultz et al.
7,063,802 B2 6/2006 Tsuda et al.
7,159,675 B2 1/2007 Eigner et al.
7,204,581 B2 4/2007 Peeters
7,219,752 B2 5/2007 Wassell et al.
7,428,922 B2 9/2008 Fripp et al.
7,743,825 B2 6/2010 O'Malley et al.
7,763,175 B2 7/2010 DeCoster et al.
7,779,933 B2 8/2010 Sihler et al.
7,950,672 B2 5/2011 Shimazaki et al.
8,056,246 B1 11/2011 Hopper et al.
8,136,594 B2 * 3/2012 Streich ..... C09K 8/42 166/292
8,230,918 B2 * 7/2012 Ameen ..... E21B 43/26 166/250.1
8,269,501 B2 9/2012 Schmidt et al.
8,286,705 B2 10/2012 Ocalan et al.
8,328,199 B2 12/2012 Oshita
8,360,170 B2 1/2013 Leuchtenberg
8,419,019 B2 4/2013 Kung
8,443,875 B2 * 5/2013 Lee ..... E21B 10/322 166/66.5
8,689,875 B2 * 4/2014 Dudley ..... E21B 43/2401 166/280.1
9,206,659 B2 * 12/2015 Zhang ..... C09K 8/70
9,512,698 B2 12/2016 Donderici et al.
9,551,203 B2 * 1/2017 Meinke ..... E21B 33/13
2003/0166470 A1 9/2003 Fripp et al.
2004/0084184 A1 5/2004 Orban et al.
2005/0006020 A1 1/2005 Jose Zitha et al.
2005/0109512 A1 * 5/2005 Zitha ..... C09K 8/5045 166/305.1
2005/0274524 A1 12/2005 Silguero et al.
2008/0290876 A1 11/2008 Ameen
2009/0008078 A1 1/2009 Patel
2009/0025928 A1 1/2009 Lee
2009/0101364 A1 4/2009 Schafer et al.
2009/0179385 A1 7/2009 Komino et al.
2010/0019514 A1 1/2010 Steinwender
2010/0126716 A1 5/2010 Joseph
2010/0187009 A1 * 7/2010 Siher ..... E21B 4/02 175/57
2010/0224360 A1 9/2010 MacDougall et al.
2010/0267594 A1 10/2010 Rana et al.
2011/0056681 A1 3/2011 Khan
2011/0108277 A1 5/2011 Dudley et al.
2011/0186297 A1 8/2011 Zhang et al.
2011/0192573 A1 8/2011 Defretin et al.
2011/0297265 A1 12/2011 Kahoe et al.
2011/0297394 A1 12/2011 VanDelden
2013/0020066 A1 1/2013 Ocalan et al.
2013/0091941 A1 4/2013 Huh et al.
2013/0105224 A1 5/2013 Donderici et al.
2013/0112911 A1 5/2013 Mazyar et al.
2013/0119995 A1 5/2013 Wootten
2013/0139565 A1 6/2013 Hedtke
2013/0169278 A1 7/2013 Bittar et al.
2013/0199650 A1 8/2013 Cabot et al.
2014/0239957 A1 * 8/2014 Zhang ..... G01V 3/30 324/334
2014/0262268 A1 * 9/2014 Kageler ..... E21B 33/134 166/292
2015/0013985 A1 1/2015 Parsche
2015/0034332 A1 * 2/2015 Merron ..... E21B 34/14 166/373
2015/0315868 A1 11/2015 Fripp et al.
2015/0345250 A1 12/2015 Murphree et al.
2016/0010424 A1 * 1/2016 van Oort ..... C09K 8/467 166/293
2016/0032688 A1 2/2016 Donderici et al.
2016/0040506 A1 2/2016 Goodman et al.
2016/0040507 A1 * 2/2016 Donderici ..... E21B 41/00 166/255.1
2016/0047204 A1 2/2016 Donderici et al.
2016/0145968 A1 5/2016 Marya
2016/0290089 A1 * 10/2016 McMillon ..... E21B 33/10
2017/0037710 A1 * 2/2017 Richards ..... E21B 43/04

FOREIGN PATENT DOCUMENTS

WO 2001061713 8/2001
WO 2005038189 4/2005
WO 2009142779 11/2009
WO 2013012967 1/2013
WO 2015094266 6/2015
WO 2015094274 6/2015
WO 2015102561 7/2015
WO 2015102563 7/2015
WO 2015102568 7/2015

OTHER PUBLICATIONS

Gollwitzer et al., The Surface Topography of a Magnetic Fluid—A Quantitative Comparison Between Experiment and Numerical Simulation, Journal of Fluid Mechanics, May 2006, pp. 1-21.
Grundfos , The Centrifugal Pump, Company Datasheet, Dec. 2003, 128 pages.
Horak et al., Experimental and Numerical Determination of the Static Critical Pressure in Ferrofluid Seals, Journal of Physics: Conference Series, vol. 412, 2013, pp. 1-6.
Pant et al., Synthesis and characterization of ferrofluid-conducting polymer composite, Indian Journal of Engineering and Materials Sciences, vol. 11, Aug. 2004., pp. 267-270.
International Patent Application No. PCT/US2013/078256 , International Search Report and Written Opinion, dated Sep. 25, 2014, 14 pages.
Raj et al., Advances in ferrofluid technology, Journal of Magnetism and Magnetic Materials, vol. 149, 1995, pp. 174-180.
Rosenweig , Magnetic Fluid Motion in Rotating Field, Journal of Magnetism and Magnetic Materials, vol. 85, Issues 1-3, Apr. 1990, pp. 171-180.

* cited by examiner

FERROFLUID TOOL FOR ISOLATION OF OBJECTS IN A WELLBORE

CROSS-REFERENCE TO RELATED APPLICATIONS

This is a U.S. national phase under 35 U.S.C. 371 of International Patent Application No. PCT/US2013/078256, titled "Ferrofluid Tool for Isolation of Objects in a Wellbore" and filed Dec. 30, 2013, the entirety of which is incorporated herein by reference.

TECHNICAL FIELD

The present disclosure relates generally to devices for use in a wellbore in a subterranean formation and, more particularly (although not necessarily exclusively), to tools for isolating objects in a wellbore using ferrofluids.

BACKGROUND

Various devices can be placed in a well traversing a hydrocarbon bearing subterranean formation. Fluids in the wellbore can have properties such as high electrical conductivity that can negatively affect the devices placed downhole in the well. In some applications, the wellbore fluids can encumber transmission of signals utilized by the downhole devices. In other applications, the wellbore fluids allow transmission of signals that can interfere with the operation of downhole devices. These and other effects of wellbore fluid can reduce efficiency and accuracy of downhole devices.

DETAILED DESCRIPTION

Certain aspects of the present disclosure are directed to ferrofluid tools for isolating objects in a wellbore. Ferrofluids, which may also be known as liquid magnets, can include materials for which position, size, and shape can be controlled using external magnetic fields. A ferrofluid tool can include a ferrofluid source for introducing ferrofluid and a magnet for providing a magnetic field. The ferrofluid source or the magnet (or both) can be controlled when the tool is in a wellbore to position the ferrofluid near the tool. The ferrofluid can displace wellbore fluid having unknown or problematic characteristics. Displacing the wellbore fluid with the ferrofluid, which can have known characteristics, can improve operation of downhole tools. For example, the ferrofluid can reduce interference from errant signals communicated through wellbore fluids to sensors of a downhole tool. In another example, the ferrofluid can insulate electrical contact points of a downhole tool to permit opposing sides of an electrical connector to be joined together without exposing the electrical contact points to conductive wellbore fluids.

These illustrative examples are given to introduce the reader to the general subject matter discussed here and are not intended to limit the scope of the disclosed concepts. The following describes various additional aspects and examples with reference to the drawings in which like numerals indicate like elements, and directional descriptions are used to describe the illustrative aspects. The following uses directional descriptions such as "above," "below," "upper," "lower," "upward," "downward," "left" "right" etc. in relation to the illustrative aspects as they are depicted in the figures, the upward direction being toward the top of the corresponding figure and the downward direction being toward the bottom of the corresponding figure. Like the illustrative aspects, the numerals and directional descriptions included in the following sections should not be used to limit the present disclosure.

Figure 1:
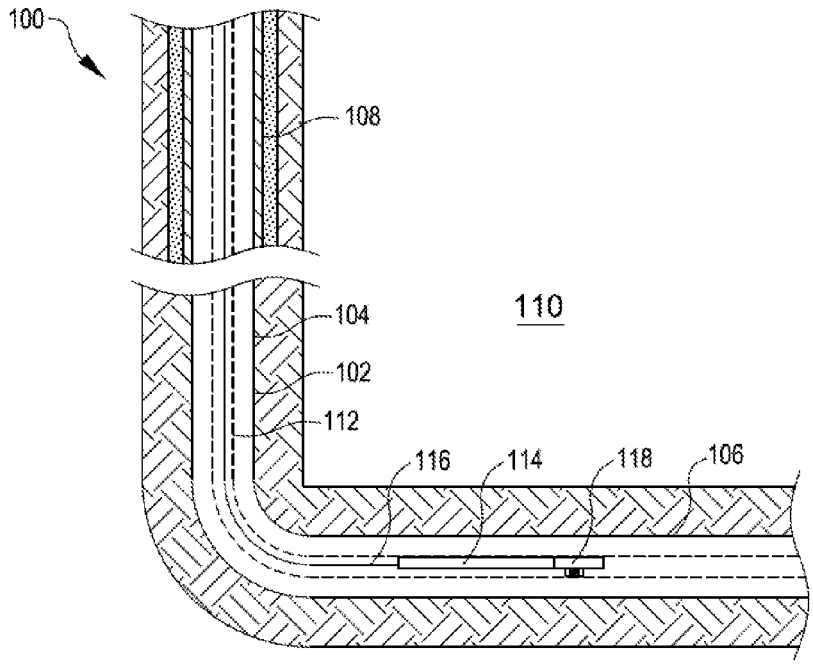
FIG. 1 is a schematic illustration of a well system having a ferrofluid tool according to one aspect of the present disclosure.

FIG. 1 schematically depicts an example of a well system 100 having a ferrofluid tool 118 that can use ferrofluids to isolate objects in a wellbore 102. Although the well system 100 is depicted with one ferrofluid tool 118, any number of ferrofluid tools can be used in the well system 100. The well system 100 includes a bore that is a wellbore 102 extending through various earth strata. The wellbore 102 has a substantially vertical section 104 and a substantially horizontal section 106. The substantially vertical section 104 and the substantially horizontal section 106 can include a casing string 108 cemented at an upper portion of the substantially vertical section 104. The substantially horizontal section 106 extends through a hydrocarbon bearing subterranean formation 110.

A tubing string 112 within the wellbore 102 can extend from the surface to the subterranean formation 110. The tubing string 112 can provide a conduit for formation fluids, such as production fluids produced from the subterranean formation 110, to travel from the substantially horizontal section 106 to the surface. Pressure from a bore in a subterranean formation 110 can cause formation fluids, including production fluids such as gas or petroleum, to flow to the surface.

The ferrofluid tool 118 can be part of a tool string 114. The ferrofluid tool 118 can be the sole tool in the tool string 114, or the tool string 114 can include other downhole tools (including other ferrofluid tools). The tool string 114 can be deployed into the well system 100 on a wire 116 or other suitable mechanism. The tool string 114 can be deployed into the tubing string 112 or independent of the tubing string 112. In some aspects, the tool string 114 can be deployed as part of the tubing string 112 and the wire 116 can be omitted. In other aspects, the tool string 114 can be deployed in a portion of a well system 100 that does not include tubing string 112.

Although FIG. 1 depicts the ferrofluid tool 118 in the substantially horizontal section 106, the ferrofluid tool 118 can be located, additionally or alternatively, in the substantially vertical section 104. In some aspects, the ferrofluid tool 118 can be disposed in simpler wellbores, such as wellbores having only a substantially vertical section 104. In some aspects, the ferrofluid tool 118 can be disposed in more complex wellbores, such as wellbores having portions disposed at various angles and curvatures. The ferrofluid tool 118 can be disposed in openhole environments, as depicted in FIG. 1, or in cased wells.

Figure 2:
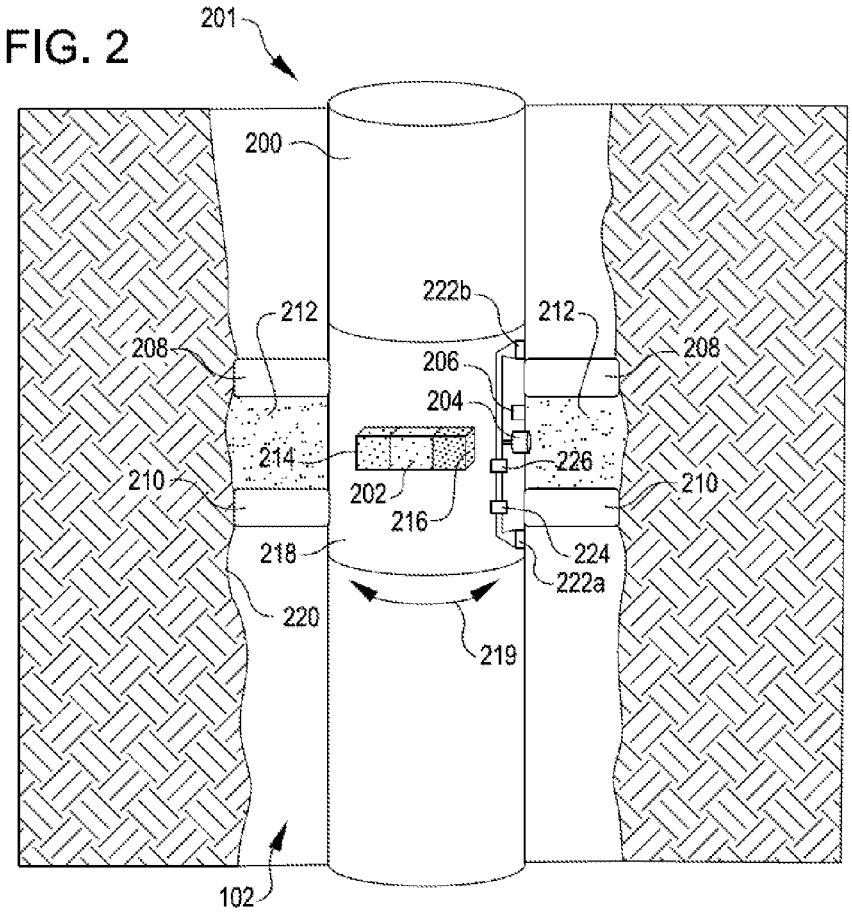
FIG. 2 is a cross-sectional view of an example of a ferrofluid tool for isolating a portion of a wall for caliper measurements according to one aspect of the present disclosure.

Various types of ferrofluid tools can be used alternatively or additionally in the well system 100 depicted in FIG. 1. FIG. 2 is a cross-sectional view of an example of a ferrofluid tool 201 for isolating a portion of a wall 220 for caliper measurements according to one aspect. In some aspects, the wall 220 is part of a wellbore formation, such as the formation 110 of FIG. 1. In other aspects, the wall 220 is part of a casing string, such as the casing string 108 of FIG. 1. In some aspects, the wall 220 is part of some other type of tubular element, such as the tubing string 112 of FIG. 1.

The ferrofluid tool 201 can include a tool body 200, a magnet 202, a ferrofluid source 204, a transducer 206, one or more ferrofluid isolators 208, 210, and one or more ferrofluid collectors 222*a*, 222*b*. In some aspects, the tool body 200 is part of a tool string, such as the tool string 114 of FIG. 1. In some aspects, the ferrofluid source 204, the magnet 202, the transducer 206, the ferrofluid collectors 222*a*, 222*b*, or some combination thereof can be controlled by a system control center in communication with the ferrofluid tool 201. The magnet 202 can be positioned in or connected with the tool body 200. For example, the magnet 202 can be on the tool body 200, directly connected to the tool body 200, or connected with the tool body 200 through intervening components or structure. Non-limiting examples of the magnet 202 include an electromagnet, a permanent magnet, and a device for producing magnetic fields. The ferrofluid source 204 can be positioned in or connected with the tool body 200. The ferrofluid source 204 can be located near the magnet 202. In some aspects, the ferrofluid source 204 can include a nozzle or a port (or both). A first ferrofluid isolator 208 and a second ferrofluid isolator 210 can be positioned external to the tool body 200. The ferrofluid isolators 208, 210 can be positioned near the ferrofluid source 204. A ferrofluid collector 222 can be positioned in or connected with the tool body 200. The transducer 206 can be connected with an exterior of the tool body 200 or within the tool body 200.

The ferrofluid source 204 can introduce ferrofluid 212 into a space between the tool body 200 and the wall 220. The magnet 202 can magnetically couple with the ferrofluid 212. The magnet 202 can exert an external magnetic field upon the ferrofluid 212. The magnetic field exerted on the ferrofluid 212 can cause the ferrofluid 212 to align with the magnetic field. The magnetic field can position the ferrofluid 212 between the tool body 200 and the wall 220. The magnetic field can arrange the ferrofluid 212 as a discrete block. The block of ferrofluid 212 can span between a portion of the ferrofluid tool 201 and a portion of the wall 220. The ferrofluid 212 can isolate the portion of the wall 220, the portion of the ferrofluid tool 201, or both from other fluids in the wellbore 102. The shape of the block of ferrofluid 212 can change in response to changes in the contour of the wall 220.

The transducer 206 can obtain a caliper measurement of a distance between the tool body 200 and the wall 220. The transducer 206 can detect variations in signals in the ferrofluid 212. Non-limiting examples of signal types that the transducer 206 can detect include acoustic signals, electrical signals, and induction signals. In some aspects, the signals detected by the transducer 206 are indicative of the size of the block of ferrofluid 212. For example, the transducer 206 can include electrodes for detecting an electrical property, such as conductivity, of the block of ferrofluid 212 that can change with the size of the block. In another example, the transducer 206 can include an induction coil for detecting a magnetic property that can change with the size of the block of ferrofluid 212. The size of the block of ferrofluid 212 can indicate the distance from the tool body 200 to the wall 220 because the shape of the block of ferrofluid 212 can change in response to changes in the contour of the wall 220. In some aspects, the transducer 206 can detect a signal reflected from the wall 220 through the block of ferrofluid 212. In one example, the transducer 206 can broadcast an acoustic signal toward the wall 220. The transducer 206 can also detect the reflection of the acoustic signal returning from the wall 220. A distance between the tool body 200 and the wall 220 can be determined based on a time delay between the broadcast and the detection of the signal.

The magnet 202 can include a first pole 216 and a second pole 214 having opposite polarities. Magnetic particles in the ferrofluid 212 can align with the magnetic field of the magnet 202 such that the ferrofluid 212 can be attracted toward either of poles 214, 216. The attraction toward both poles 214, 216 can cause the ferrofluid 212 to tend to spread out along the face of the tool body 200 to follow the minimum magnetic path length between the two poles 214, 216. The ferrofluid isolators 208, 210 can obstruct the path of the ferrofluid 212 and prevent the ferrofluid 212 from spreading out along the face of the tool body 200. The ferrofluid isolators 208, 210 can be constructed of material having low magnetic permeability. An example of material from which the ferrofluid isolators 208, 210 can be constructed includes rubber. The ferrofluid isolators 208, 210 can retain the ferrofluid 212 in the magnetic field of the magnet 202 in a shape protruding from the face of the tool body 200 defined between the ferrofluid isolators 208, 210.

The ferrofluid isolators 208, 210 can guide the ferrofluid 212 from the ferrofluid source 204. For example, the ferrofluid isolators 208, 210 can be positioned respectively above and below the ferrofluid source 204 such that the ferrofluid 212 is substantially retained in a vertical region between the ferrofluid isolators 208, 210. Any number, shape, or arrangement (or combination thereof) of ferrofluid isolators 208, 210 can be used to retain ferrofluid 212 in a region bounded by at least one ferrofluid isolator 208, 210. Another example arrangement of ferrofluid isolators is described with respect to FIG. 3 below.

The ferrofluid isolators 208, 210 can guide the ferrofluid 212 to focus the shape of the block of ferrofluid 212. Focusing the shape of the block of ferrofluid 212 can provide known dimensions of the block of ferrofluid 212. Known dimensions increase the accuracy of distance measurements that are based on the size of the block of ferrofluid 212.

The ferrofluid collectors 222*a*, 222*b* can recover ferrofluid 212 introduced by the ferrofluid source 204. In some aspects, the ferrofluid collectors 222*a*, 222*b* can be positioned for collecting ferrofluid 212 that spreads beyond an area between the ferrofluid isolators 208, 210. In some aspects, the ferrofluid collectors 222*a*, 222*b* can alternatively or additionally be placed along the circumference of the ferrofluid tool 201. Placement along the circumference can provide collection of ferrofluid 212 that is spreading out along the face of the tool body 200 to follow the minimum magnetic path length between the two poles 214, 216 of the magnet 202. The ferrofluid collectors 222*a*, 222*b* can communicate collected ferrofluid 212 to the ferrofluid source 204. In some aspects, the ferrofluid tool 201 can include a tank 224. The tank 224 can store ferrofluid 212 conveyed by the ferrofluid source 204, store ferrofluid 212 collected by the ferrofluid collectors 222*a*, 222*b*, or both. In some aspects, the ferrofluid tool 201 can include a filter 226 for separating collected ferrofluid 212 from collected wellbore fluids. Although the ferrofluid tool 201 is depicted in FIG. 2 with two ferrofluid collectors 222*a*, 222*b*, one tank 224, and one filter 226, the ferrofluid tool 201 can utilize any number or arrangement of these components.

The ferrofluid tool 201 can provide a profile of the wall 220 by obtaining and combining multiple distance measurements. In some aspects, the multiple measurements can be made by a single sensor 206. In one example, the ferrofluid tool 201 can be rotated, and the transducer 206 can obtain multiple measurements during the rotation of the ferrofluid tool 201. In another example, the transducer 206 can be rotatable relative to the tool body 200 and independently of the block of ferrofluid 212. The block of ferrofluid 212 can be positioned in a column surrounding a portion of the tool body 200. The transducer 206 can rotate for taking measurements at different locations in the column. In another example, a rotatable section 218 of the tool body 200 can rotate (such as depicted by the arrow 219 in FIG. 2) to rotate the block of ferrofluid 212 and the transducer 206 together relative to the tool body 200. The rotatable section 218 can include some combination of the ferrofluid source 204, the magnet 202, or the ferrofluid isolators 208, 210 such that the block of ferrofluid 212 can be confined to a shape positioned adjacent to the transducer 206. The transducer 206 can obtain multiple measurements through the block of ferrofluid 212 as the block of ferrofluid 212 and the transducer 206 are rotated together relative to the tool body 200. In some aspects, multiple measurements can be made by multiple sensors 206. The multiple sensors 206 can be stationary or rotatable relative to the tool body 200. The multiple sensors 206 can function with one or more blocks of ferrofluid 212, which can be stationary or rotatable relative to the tool body 200.

Figure 3:
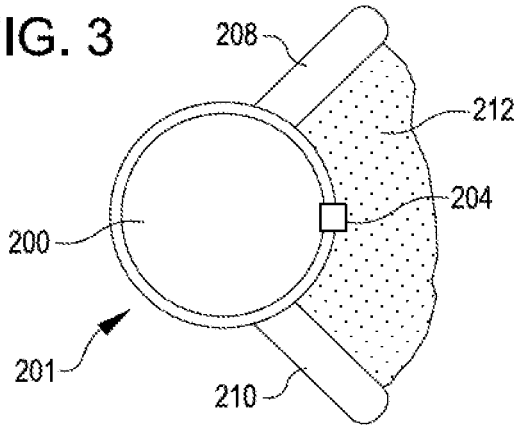
FIG. 3 is a top cross-sectional view of the ferrofluid tool of FIG. 2 according to one aspect of the present disclosure.

FIG. 3 is a top cross-sectional view of the ferrofluid tool of FIG. 2 according to one aspect of the present disclosure. FIG. 3 depicts an arrangement of ferrofluid isolators 208, 210 that can be used alternatively or in addition to the arrangement of ferrofluid isolators 208, 210 depicted in FIG. 2. Ferrofluid isolators 208, 210 can be positioned, respectively, laterally to the left and right of the ferrofluid source 204 such that the ferrofluid 212 is substantially retained in a lateral region or a horizontal region between the ferrofluid isolators 208, 210. In some aspects, laterally positioned ferrofluid isolators 208, 210 can prevent ferrofluid 212 from flowing around a circumference of the tool body 200 of the ferrofluid tool 201. Preventing ferrofluid 212 from flowing around the circumference can provide paths for flow of wellbore fluids along a length of the ferrofluid tool 201.

Figure 4:
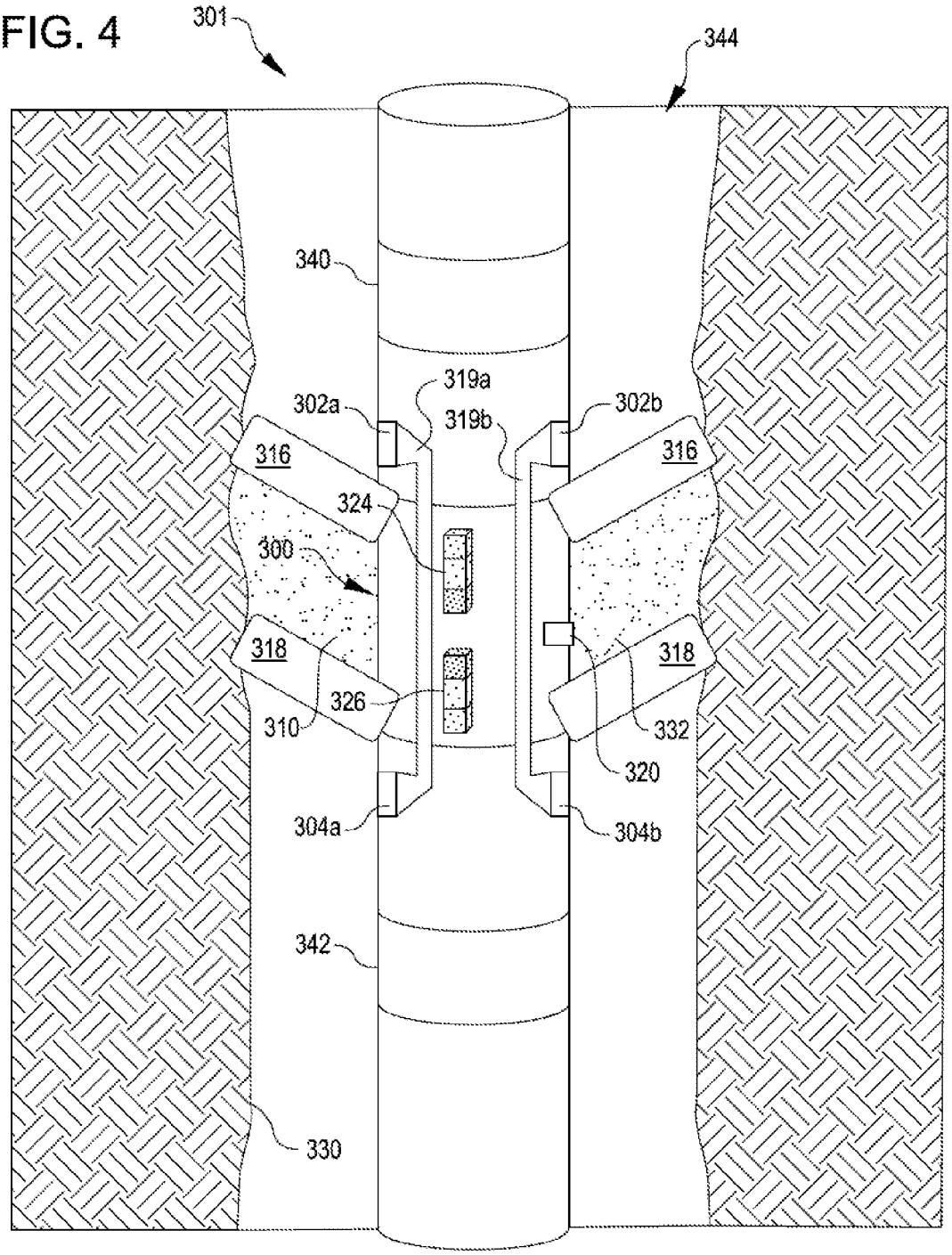
FIG. 4 is a cross-sectional view of an example of a ferrofluid tool with ferrofluid for isolating multiple tools on a tool string according to one aspect of the present disclosure.

FIG. 4 is a cross-sectional view of an example of a ferrofluid tool 301 with ferrofluid 310 for isolating multiple tools 340, 342 on a tool string 344 according to another aspect. The ferrofluid tool 301 can include a tool body 300, one or more mud-flow passageways 319, an upper mud baffle 316, a lower mud baffle 318, a ferrofluid source 320, a first magnet 324, and a second magnet 326.

The lower mud baffle 318 can be positioned between the tool body 300 and a wall 330. The wall 330 can be part of a wellbore formation, a casing string, or other type of tubular element. The lower mud baffle 318 can provide an annular barrier around the tool body 300 to prevent flow of wellbore fluids past the lower mud baffle 318 along an annulus between the tool body 300 and the wall 330. The lower mud baffle 318 can prevent flow of wellbore fluids upward. The upper mud baffle 316 can be positioned to prevent the flow of wellbore fluids downward past the upper mud baffle 316 into the annulus between the tool body 300 and the wall 330. With the mud baffles 316, 318 so configured, wellbore fluid can be at least partially prevented from entering a sheltered region 332 of the annulus defined between the upper mud baffle 316 and the lower mud baffle 318. Although the mud baffles 316, 318 are depicted in FIG. 4 with distal ends positioned uphole relative to the proximal ends, other arrangements are possible. For example, the distal ends may positioned downhole relative to the proximal ends. In some aspects, flexibility of the mud baffles 316, 318 allows the ferrofluid tool 301 to be raised or lowered in the wellbore without interfering with the sheltered region between the mud baffles 316, 318.

The mud-flow passageways 319 can be positioned internal to the tool body 300. Although the ferrofluid tool 301 is depicted in FIG. 4 with two mud-flow passageways 319*a*, 319*b*, the ferrofluid tool 301 can include any number of mud-flow passageways 319, including one or zero. A mud-flow passageway 319 can include a lower opening 304 and an upper opening 302. The mud-flow passageway 319 can provide a flow path for wellbore fluid to pass between a position below the lower mud baffle 318 and a position above the upper mud baffle 316. For example, the lower mud baffle 318 can divert a flow of wellbore fluid through the lower opening 304*a* of a mud-flow passageway 319*a*. The wellbore fluid can flow through the tool body 300 via the mud-flow passageway 319*a*. Wellbore fluid can exit the mud-flow passageway 319*a* via the upper opening 302*a*. Wellbore fluid exiting the upper opening 302*a* of the mud-flow passageway 319*a* can reenter the annulus above the upper mud baffle 316. Flow of wellbore fluids through the tool body 300 via a mud-flow passageway 319 can reduce an amount of wellbore fluid entering the sheltered region 332 between the upper mud baffle 316 and the lower mud baffle 318. Reducing the amount of wellbore fluid that can enter the sheltered region 332 between the mud baffles 318, 316 can reduce pressure from flow of wellbore fluids exerted against ferrofluid 310 that is emitted from the ferrofluid source 320.

The first magnet 324 and the second magnet 326 can be positioned opposite one another with poles of the same polarity pointing together. The first magnet 324 and the second magnet 326 so configured can produce an elongated magnetic field around the tool body 300 having a radial pattern in the region between the magnets 324, 326.

The ferrofluid source 320 can introduce ferrofluid 310 into the sheltered region 332. The ferrofluid 310 can displace wellbore fluid in the sheltered region 332. The ferrofluid 310 can align between the tool body 300 and the wall 330 in response to the magnetic field produced by the magnets 324, 326. The magnetic field can arrange the ferrofluid 310 as a discrete block. The block of ferrofluid 310 can span between a portion of the ferrofluid tool 301 and a portion of the formation 110. The magnetic field can arrange the ferrofluid 310 in a radially omnidirectional shape about an exterior portion of the tool body 300.

The ferrofluid tool 301 can be part of a tool string 344. The tool string 344 can also include a first tool 340 and a second tool 342. The block of ferrofluid 310 produced by the ferrofluid tool 301 can be positioned between the first tool 340 and the second tool 342. Positioning the block of ferrofluid 310 between the first and second tools 340, 342 can isolate the first and second tools 340, 342 from one another. For example, the block of ferrofluid 310 can reduce transmission of signals between the first and second tools 340, 342 through the borehole that might otherwise interfere with the accuracy or proper operation of the first and second tools 340, 342.

Figure 5:
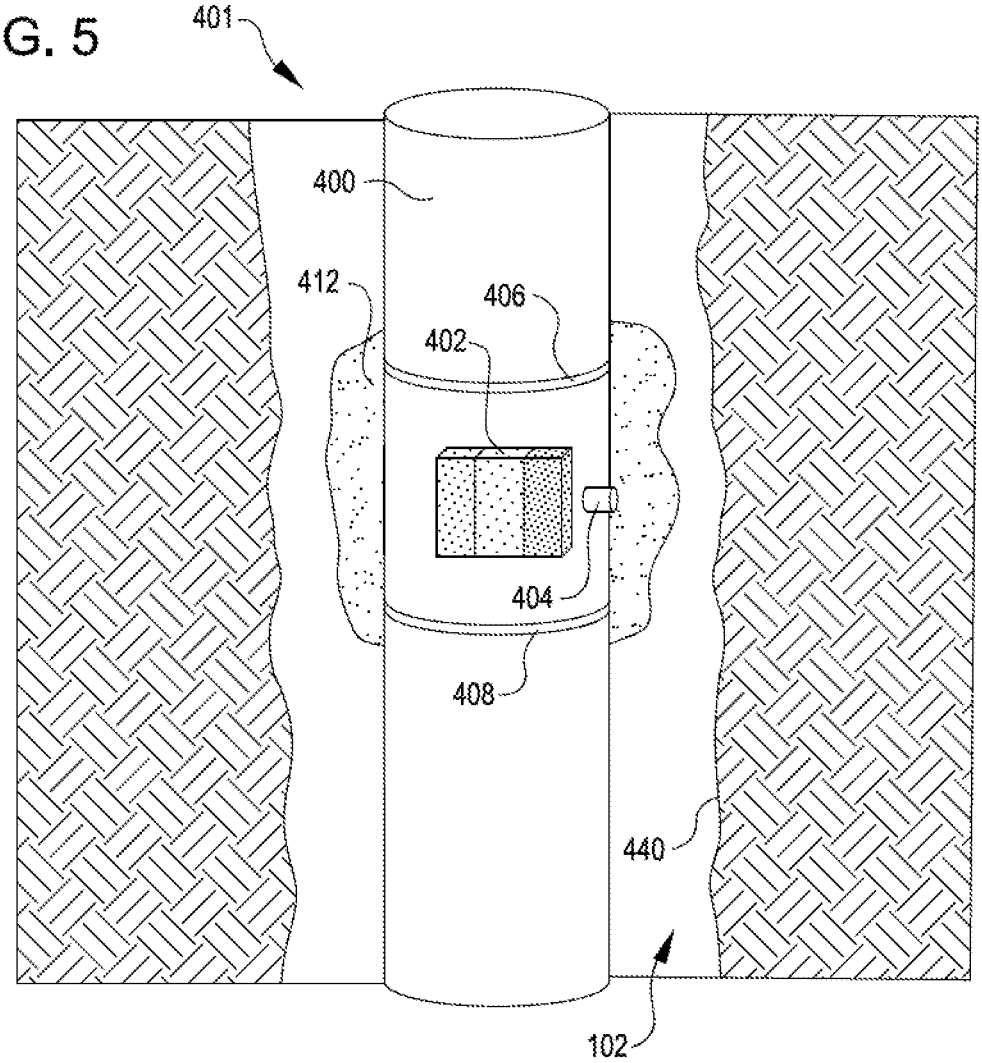
FIG. 5 is a cross-sectional view of an example of a ferrofluid tool for isolating sensors according to one aspect of the present disclosure.

FIG. 5 is a cross-sectional view of an example of a ferrofluid tool 401 for isolating sensors 406, 408 according to one aspect. The ferrofluid tool 401 can include a tool body 400, a magnet 402, a ferrofluid source 404, a first sensor 406, and a second sensor 408. In some aspects, the first sensor 406 and the second sensor 408 can be negatively impacted by effects of fluids present in the wellbore 102. For example, the first sensor 406 and the second sensor 408 can be induction coils that are susceptible to signal noise created due to Eddy currents induced in conductive borehole fluid.

The ferrofluid source 404 can introduce ferrofluid 412 into a space between the tool body 400 and a wall 440. The wall 440 can be part of a wellbore formation, a casing string, or other type of tubular element. The magnet 402 can exert an external magnetic field upon the ferrofluid 412. The magnetic field exerted on the ferrofluid 412 can cause the ferrofluid 412 to align with the magnetic field. The magnetic field can position the ferrofluid 412 between the tool body 400 and the wall 440. The magnetic field can arrange the ferrofluid 412 as a discrete block. The block of ferrofluid 412 can be positioned adjacent to the first sensor 406 and the second sensor 408. The block of ferrofluid 412 can insulate the first sensor 406 and the second sensor 408 from other fluids present in the wellbore 102. Insulating the first sensor 406 and the second sensor 408 from other fluids present in the wellbore 102 can isolate the sensors 406, 408 from the effects of the borehole fluids that can reduce the accuracy of the sensors 406, 408. In some aspects, the configuration of opposite-facing magnets 324, 326 depicted in FIG. 4 can be substituted for the magnet 402 in the ferrofluid tool 401. This configuration can produce strong radial magnetic flux lines for aligning the ferrofluid 412.

Although the ferrofluid tool 401 is depicted in FIG. 5 as having one magnet 402 and two sensors 406, 408, other arrangements are possible. For example, the ferrofluid tool 401 can include multiple magnets and one sensor or more than two sensors. In some aspects, the ferrofluid tool 401 can include ferrofluid isolators, collectors, filters, tanks, or some combination of these and other components discussed herein.

Figure 6:
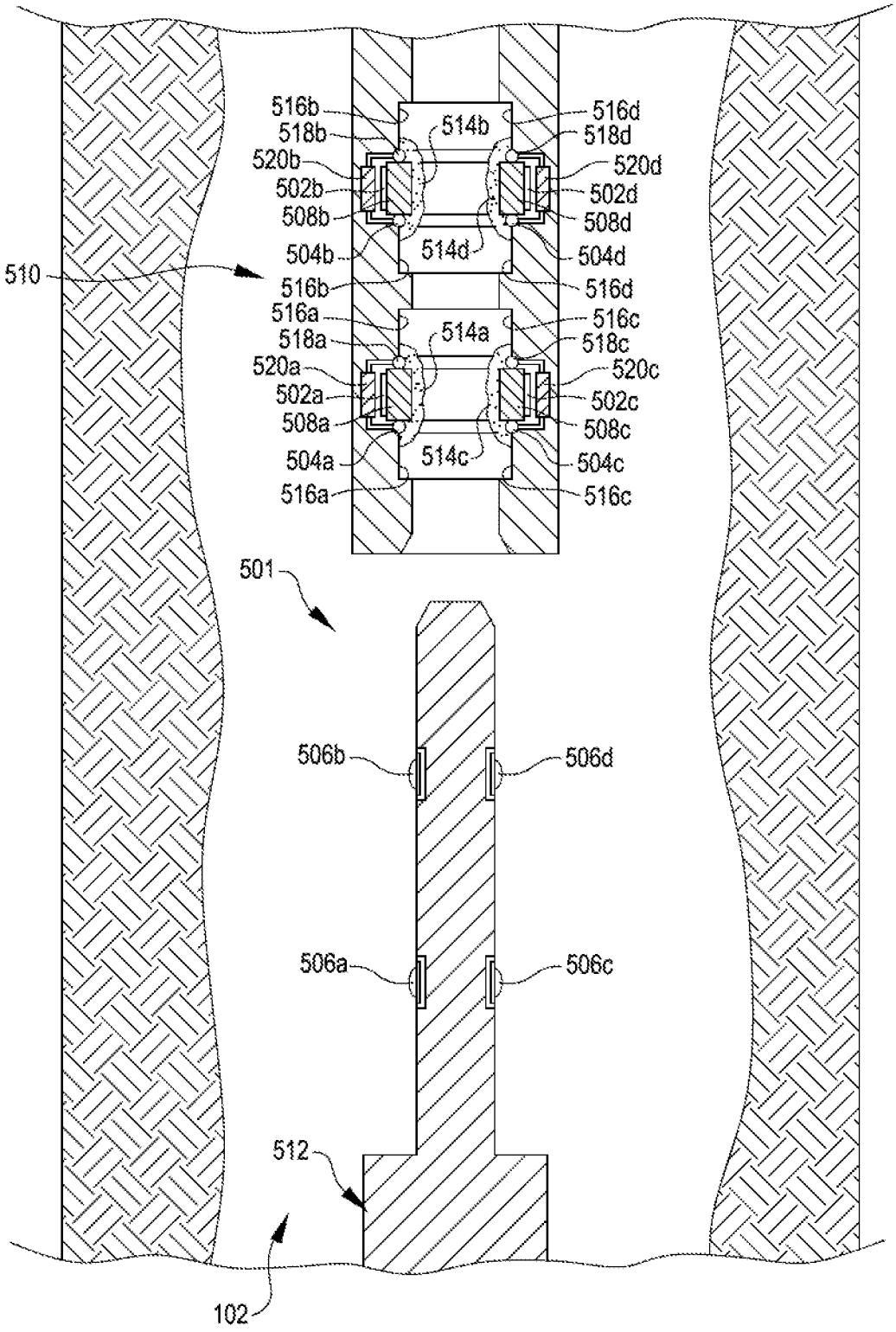
FIG. 6 is a cross-sectional view of an example of a ferrofluid tool for isolating electrical contacts from fluids in a wellbore with a first connector component and a second connector component according to one aspect of the present disclosure.

FIG. 6 is a cross-sectional view of an example of a ferrofluid tool 501 for isolating electrical contacts 508 from fluids in a wellbore 102 according to one aspect. The ferrofluid tool 501 can include a first connector 510 and a second connector 512. The first connector 510 can engage the second connector 512 to provide an electrical connection between two devices positioned downhole.

The first connector 510 can include one or more first electrical contacts 508, magnets 502, ferrofluid sources 504, ferrofluid collectors 518, tanks 520, and recesses 516. A first electrical contact 508 can be connected to a source of electricity. A magnet 502 can be positioned adjacent to the first electrical contact 508. In some aspects, the magnet 502 is part of the first electrical contact 508. A recess 516 can be positioned adjacent to the first electrical contact 508. A ferrofluid source 504 and a ferrofluid collector 518 can be positioned adjacent to the first electrical contact 508. For example, the ferrofluid source 504 and the ferrofluid collector 518 can be positioned in the recess 516. A tank 520 can provide storage for ferrofluid 514. The tank 520 can be in fluid communication with the ferrofluid source 504 and the ferrofluid collector 518.

The ferrofluid source 504 can provide ferrofluid 514. In one example, the ferrofluid source 504 can be a nozzle for introducing ferrofluid 514 from the tank 520. In another example, the ferrofluid source 504 can be a discrete quantity of ferrofluid 514 held in place near the magnet 502 by a magnetic field from the magnet 502. The magnet 502 can provide a magnetic field for retaining the ferrofluid 514 adjacent to the first electrical contact 508. Retaining ferrofluid 514 adjacent to the first electrical contact 508 can isolate or insulate the first electrical contact 508 from fluids in the well system 100. Isolating the first electrical contact 508 can prevent conductive fluids in the well system from conducting energy from the first electrical contact 508, which might otherwise cause short-circuiting or other damage to the first electrical contact 508.

The second connector 512 can include one or more second electrical contacts 506. A second electrical contact 506 can be arranged for engaging the first electrical contact 508 for providing an electrical connection. In some aspects, the second electrical contact 506 is not connected to any source of electricity, and the second electrical contact 506 can be exposed to fluids in the wellbore 102 without risk of damage to the second electrical contact 506.

Figure 7:
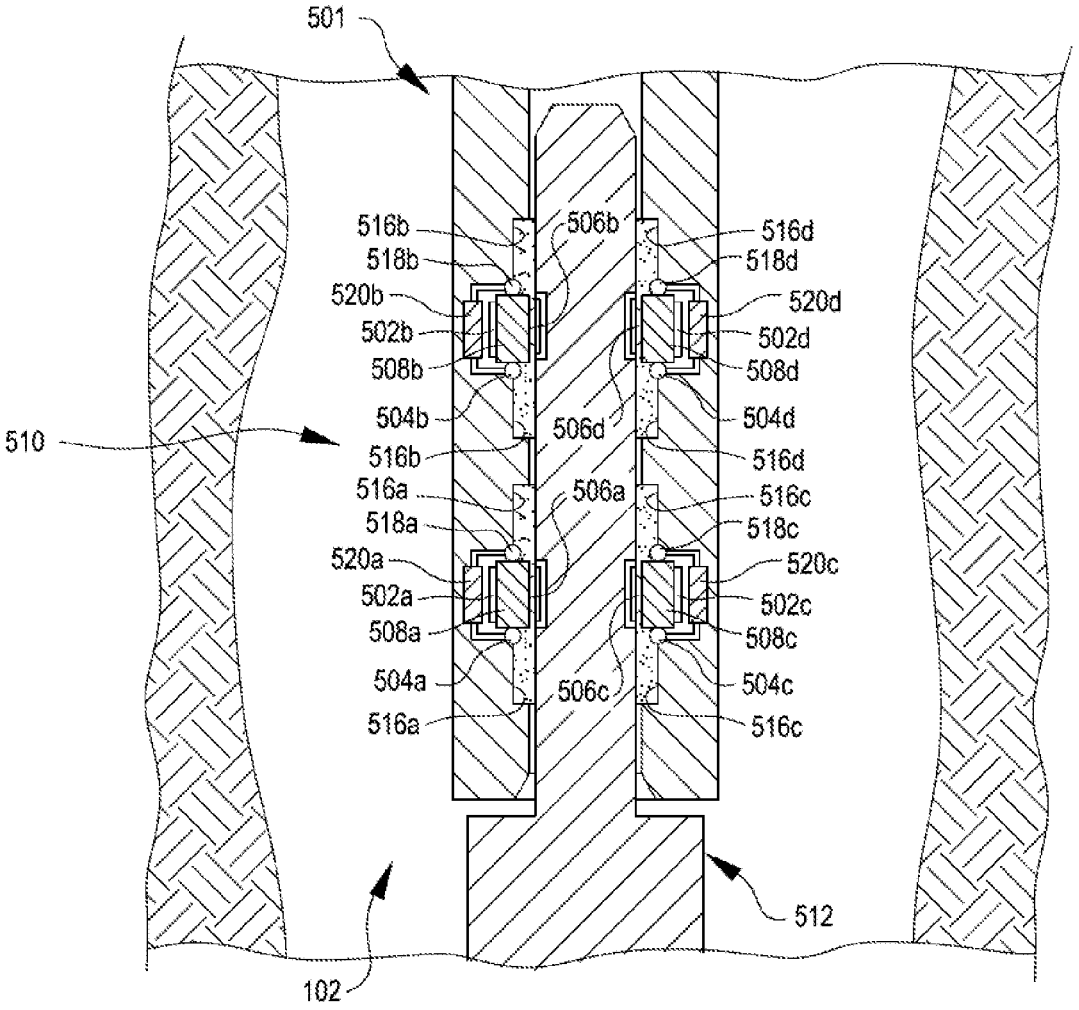
FIG. 7 is a cross-sectional view of the ferrofluid tool of FIG. 6 in which the first connector is engaged with the second connector according to one aspect of the present disclosure.

FIG. 7 is a cross-sectional view of the ferrofluid tool 501 of FIG. 6 with the first connector 510 engaged with the second connector 512 according to one aspect. Engagement of the first connector 510 with the second connector 512 can cause the ferrofluid 514 adjacent to the first electrical contact 508 to displace. For example, the ferrofluid 514 can displace into the recess 516 adjacent to the first electrical contact 508. Displacement of the ferrofluid 514 can allow contact between the first electrical contact 508 and the second electrical contact 506. Contact between the electrical contacts 506, 508 can provide an electrical connection between the first connector 510 and the second connector 512.

Figure 8:
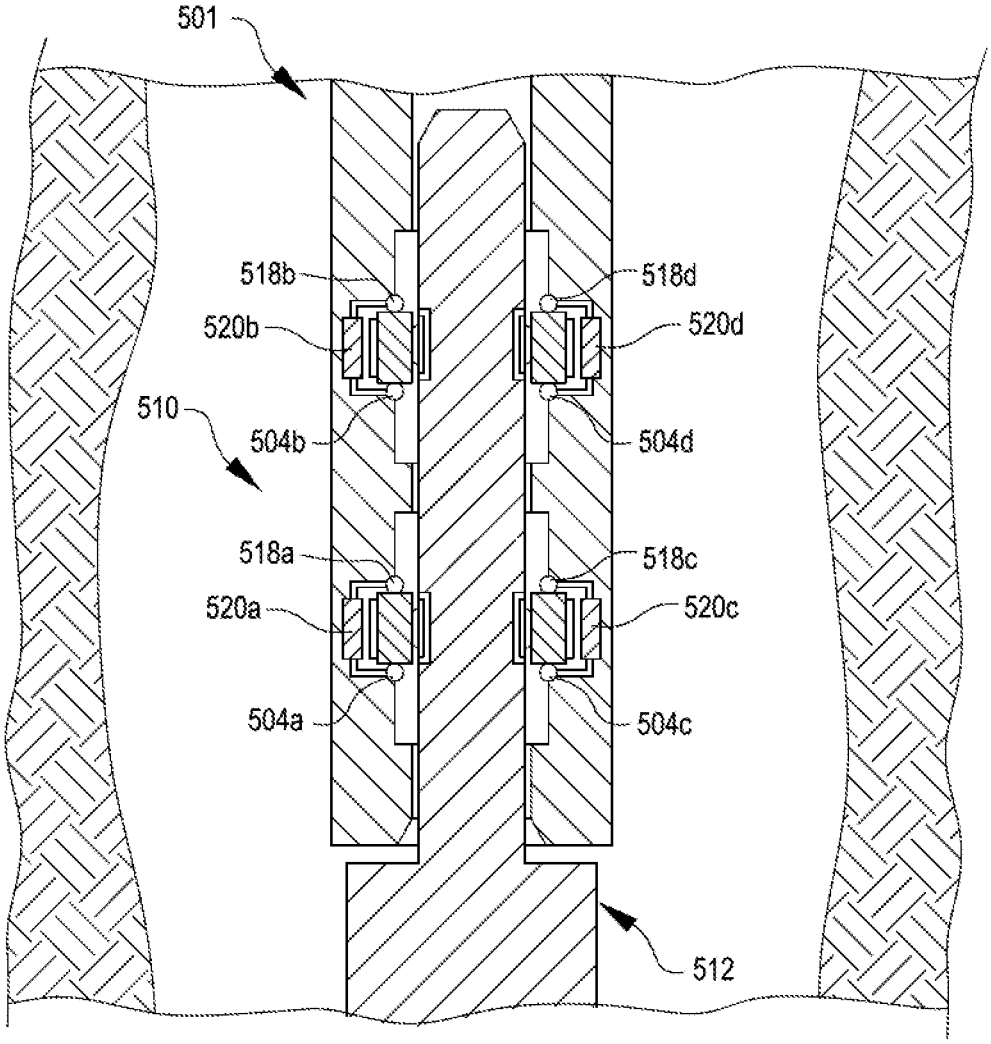
FIG. 8 is a cross-sectional view of the ferrofluid tool of FIG. 6 in which the first connector is engaged with the second connector in the absence of ferrofluid according to one aspect of the present disclosure.

FIG. 8 is a cross-sectional view of the ferrofluid tool 501 of FIG. 6 with the first connector 510 engaged with the second connector 512 in the absence of ferrofluid 514 according to one aspect. The ferrofluid collector 518 can collect ferrofluid 514 displaced by the engagement of the first connector 510 and the second connector 512. The ferrofluid collector 518 can convey the collected ferrofluid 514 to the ferrofluid tank 520. The ferrofluid tank 520 can store the ferrofluid 514.

Separation of the first connector 510 and the second connector 512 can permit the ferrofluid 514 to return to an isolating position adjacent to the first electrical contact 508. In some aspects, the ferrofluid source 504 can re-introduce the ferrofluid 514 collected by the ferrofluid collectors 518 and stored in the ferrofluid tanks 520. In some aspects, the magnetic field provided by the magnets 502 can cause the ferrofluid 514 to return to the isolating position from the recess 516.

Although the ferrofluid tool 501 is depicted in FIGS. 6-8 as described above, other arrangements are possible. For example, the first connector 510 can have more or less than the four electrical contacts 508 depicted in FIGS. 6-8. In another non-limiting example, the second connector 510 can include components for isolating the second electrical contacts 506 using ferrofluid 514. In some aspects, various components depicted in FIGS. 6-8 can be omitted. In one non-limiting example, the first connector 510 can be provided without a tank 520, without a ferrofluid collector 518, and without a nozzle or other port for introducing ferrofluid 514. In such an arrangement, a ferrofluid source 504 that is a discrete quantity of ferrofluid 514 can provide ferrofluid 514 that can be adjacent to the contacts 508 for isolating the contacts 508 when the connectors 510, 512 are not joined and that can be displaced into the recesses 516 for storage when the connectors 510, 512 are joined.

Figure 9:
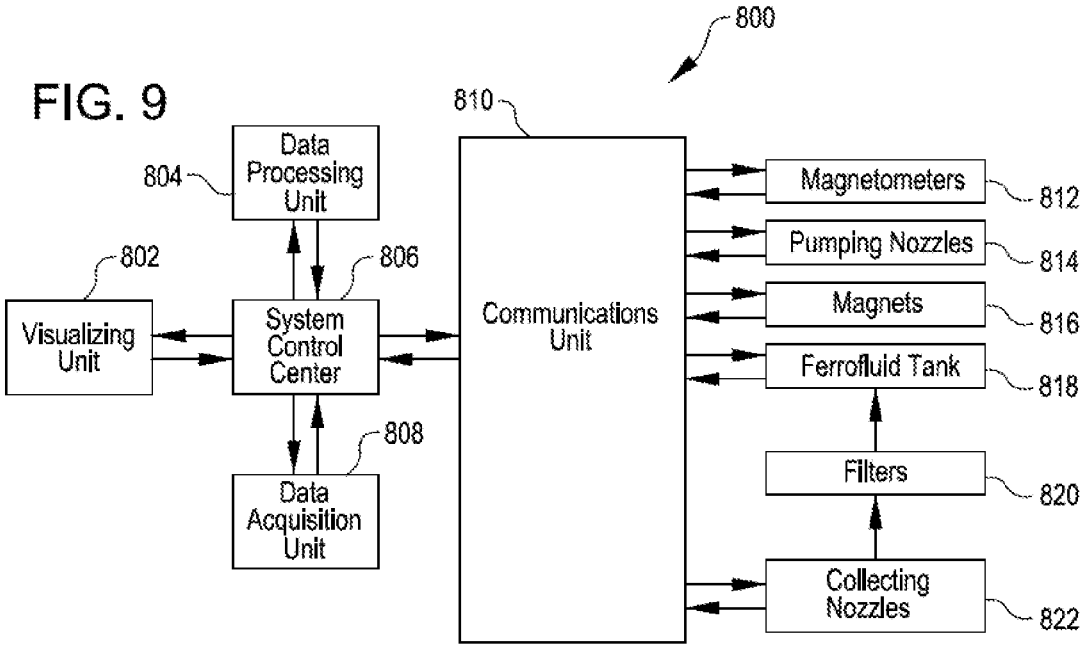
FIG. 9 is a block diagram of an example of a system for using ferrofluid for isolating objects in a wellbore according to one aspect of the present disclosure.

FIG. 9 is a block diagram depicting an example of a system 800 for using ferrofluid for isolating objects in a wellbore according to one aspect of the present disclosure. The system 800 can include a system control center 806, a visualizing unit 802, a data processing unit 804, a data acquisition unit 808, a communications unit 810, magnetometers 812, pumping nozzles 814, magnets 816, ferrofluid tank 818, filters 820, and collecting nozzles 822. The system 800 can include more or fewer than all of these listed components.

The system control center 806 can control the operation of the system for enhancing magnetic fields of a tool positioned in the wellbore. The system control center 806 can include a processor device and a non-transitory computer-readable medium on which machine-readable instructions can be stored. Examples of non-transitory computer-readable medium include random access memory (RAM) and read-only memory (ROM). The processor device can execute the instructions to perform various actions, some of which are described herein. The actions can include, for example, communicating with other components of the system 800.

The system control center 806 can communicate via the communications unit 810. For example, the system control center 806 can send commands to initiate or terminate the pumping nozzles 814 via the communications unit 810. The communications unit 810 can also communicate information about components to the system control center 806. For example, the communications unit 810 can communicate a status of the pumping nozzle 814, such as pumping or not, to the system control center 806.

The system control center 806 can receive information via communications unit 810 from magnetometers 812. Magnetometers 812 can be configured to detect a presence of ferrofluids in the annulus. For example, the magnetometers 812 can detect a level of ferrofluid introduced into the annulus by the ferrofluid source or pumping nozzle 814. The magnetometer 812 can also detect a level of ferrofluid at a position away from the pumping nozzle 814 to detect a level of ferrofluid that has escaped from the magnetic field of magnets 816. The system control center 806 can also communicate via the communications unit 810 with the magnetometers 812. For example, the system control center 806 can send instructions for the magnetometers 812 to initiate or terminate detection.

The system control center 806 can also communicate via the communications unit 810 with the magnets 816. For example, the system control center 806 can send instructions to initiate or terminate magnetic fields provided by the magnet 816. For example, the magnet 816 can be an electromagnet and the system control center 806 can provide instructions regarding whether to provide current to the electromagnet to cause the electromagnet to produce a magnetic field. The system control center 806 can also communicate with the magnets 816 to provide instructions to move the magnets 816 or adjust the magnetic field produced by the magnets 816, such as to adjust the field intensity or directionality. Movement of the magnets 816 or the magnetic field produced by the magnets 816 can provide additional control over ferrofluids positioned in the wellbore. Additional control over the ferrofluids in the wellbore can provide additional control over magnetic fields from the tool. The magnet 816 can also communicate with the system control center 806 via the communications unit 810, such as regarding the strength of the magnetic field the magnet 816 is producing.

The system control center 806 can also communicate via the communications unit 810 with the collecting nozzles 822. For example, the system control center 806 can send instructions to the collecting nozzles 822 to initiate or terminate collection of ferrofluids from the wellbore. The system control center 806 can initiate the collecting nozzles 822 based on information received from the magnetometers 812, the pumping nozzles 814, the magnets 816, or any combination thereof. The communications unit 810 can also communicate information about the collecting nozzles 822 to the system control center 806. For example, the communications unit 810 can communicate a status of the collecting nozzle 822, such as pumping or not, or how much ferrofluid is being collected by the collecting nozzle 822.

The system control center 806 can also communicate via the communications unit 810 with the ferrofluid tank 818. For example, the system control center 806 can receive information from the ferrofluid tank 818 regarding the status of the ferrofluid tank 818, such as how full the ferrofluid tank 818 is. The system control center 806 can also initiate or terminate collection by the collecting nozzles 822 based on the information received from the ferrofluid tank 818. The system control center 806 can provide instructions to the ferrofluid tank 818 to initiate filling of the ferrofluid tank 818 from another source distinct from the collecting nozzles 822, such as from a line for refilling the ferrofluid tank 818 from the surface.

One or more filters 820 can be provided to separate ferrofluid fluid from wellbore fluid in the fluid that has been collected by collecting nozzles 822. The filter 820 can convey collected ferrofluid fluid into the ferrofluid tank 818. The system control center 806 can also communicate with the filter 820 via communications unit 810. For example, the system control center 806 can send instructions to the filter 820 regarding whether the filter 820 is to perform its filtering function based on the information received by the magnetometers 812, the collecting nozzles 822, etc. The communications unit 810 can also communicate information about the filters 820 to the system control center 806. For example, the communications unit 810 can communicate a status of the filters 820, such as filtering or not, or how much ferrofluid is being filtered by the filters 820, or whether the filters 820 need to be changed or not.

The system control center 806 can also be in communication with a data acquisition unit 808. The data acquisition unit 808 can acquire data from any of the units depicted in FIG. 9 or any other sensors that are included in the system 800.

The system control center 806 can also be in communication with a data processing unit 804. The data processing unit 804 can include a processor device and a non-transitory computer-readable medium on which machine-readable instructions can be stored. The processor device can execute the instructions to perform various actions, some of which are described herein. As a non-limiting example, the data processing unit 804 can process data acquired by the data acquisition unit 808. For example, the data processing unit 804 can provide information based on acquired data that is used for determining whether to activate pumping nozzles 814, operate magnets 816, or operate collection nozzles 822, or any combination thereof.

The system control center 806 can also be in communication with a visualizing unit 802. The visualizing unit 802 can provide an interface for an operator of the system to check system operation and input intervening commands if necessary. Such intervening commands can override default or preset conditions earlier entered or used by the system control center 806.

Visualizing unit 802, data processing unit 804, system control center 806, data acquisition unit 808 and communications unit 810 can be positioned or located at the surface of a well system 100. Alternatively, one or multiple of these components can also be located in a tool positioned within a wellbore rather than at the surface.

Figure 10:
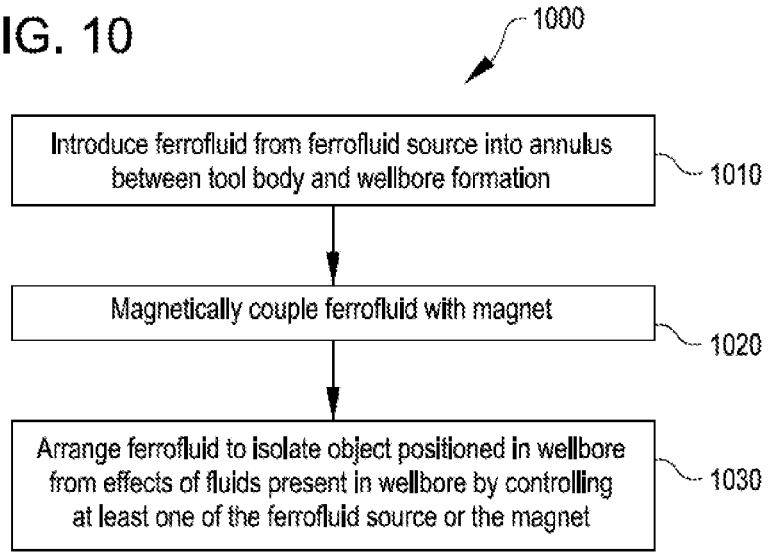
FIG. 10 is a flow chart illustrating an example method 1000 for isolating objects in a wellbore using ferrofluids according to one aspect of the present disclosure.

FIG. 10 is a flow chart illustrating an example method 1000 for isolating objects in a wellbore using ferrofluids according to one aspect of the present disclosure. The method can include introducing ferrofluid from a ferrofluid source into an annulus, as shown in block 1010. The ferrofluid source can be part of a downhole system having a tool body, the ferrofluid source, and a magnet. The annulus can be defined between the tool body and a wellbore formation. For example, a ferrofluid tool such as ferrofluid tool 201 (described above with respect to FIGS. 2-3) can be utilized in the method 1000.

The method can include magnetically coupling the ferrofluid with the positioning magnet, as shown in block 1020. The method can include arranging the ferrofluid to isolate an object positioned in a wellbore from effects of fluids present in the wellbore by controlling at least one of the ferrofluid source or the magnet, as shown in block 1030.

A ferrofluid can be a substance in which ferromagnetic particles are suspended in a carrier liquid. A ferrofluid can be a solution in which ferromagnetic particles are a solute dissolved in a carrier liquid solvent. The ferromagnetic particles in a ferrofluid can move freely inside the carrier liquid without settling out of the carrier liquid. The ferromagnetic particles inside a ferrofluid can be randomly distributed in the absence of an external magnetic field such that there is no net magnetization. Applying an external magnetic field to a ferrofluid can cause magnetic moments of the ferromagnetic particles to align with the external magnetic field to create a net magnetization. A shape or position (or both) of a ferrofluid can be controlled by changing a strength or a gradient (or both) of an external magnetic field applied to the ferrofluid.

Surfactants can be used in manufacturing ferrofluids. Surfactants can prevent ferromagnetic particles from adhering together, which can otherwise cause the ferromagnetic particles to form heavier clusters that could precipitate out of the solution.

Many different combinations of ferromagnetic particle, surfactant, and carrier fluid can be utilized to produce a ferrofluid. The variety of combinations can provide extensive opportunities to optimize the properties of a ferrofluid to a particular application. In one example, appropriate selection of the materials composing a ferrofluid can provide a ferrofluid that is more electrically conductive or more electrically resistive in accordance with the goals of a particular application.

Examples of ferromagnetic particles that can be used in ferrofluids include cobalt, iron, and iron-cobalt compounds (such as magnetite). A ferrofluid can use ferromagnetic particles of a single kind, a single composition, or a variety of kinds or compositions. Dimensions of the ferromagnetic particles in a ferrofluid can be small, e.g., in the order of nanometers (nm). In one example, a ferrofluid can have an average ferromagnetic particle size of 10 nm.

Examples of surfactants that can be used in ferrofluids include cis-oleic acid, tetramethylammonium hydroxide, citric acid and soy-lecithin. In some applications, the type of surfactant used can be a determining factor in the useful life of a ferrofluid. In various applications, a ferrofluid can be a stable substance that can be reliably used for several years before the surfactants lose effectiveness.

Examples of carrier fluids include water-based fluids and oil-based fluids. In one example, a ratio by weight in a ferrofluid can be 5% ferromagnetic particles, 10% surfactants, and 85% carrier liquid.

What is claimed is:

1. A method comprising:

introducing, by a downhole system having a tool body, a ferrofluid source, and a magnet, ferrofluid from the ferrofluid source into an annulus between the tool body and a wellbore formation;

magnetically coupling the ferrofluid with the magnet;

arranging the ferrofluid to span between the tool body and a portion of a subterranean formation to isolate an object positioned in a wellbore and the portion of the subterranean formation from effects of fluids present in the wellbore by controlling at least one of the ferrofluid source or the magnet; and measuring a distance between the tool body and the portion of the subterranean formation.

2. The method of claim 1, further comprising:

rotating at least a part of the tool body from a position at which the distance between the tool body and the portion of the subterranean formation is measured;

arranging the ferrofluid from the source to span between the tool body and a second portion of the subterranean formation to isolate the second portion of the subterranean formation from effects of fluids present in the wellbore; and measuring a second distance between the tool body and the second portion of the subterranean formation.

3. A system comprising:

memory that stores machine-readable instructions; and at least one processor device programmed to access the memory and execute the machine-readable instructions to collectively at least:

introduce, by a downhole system having a tool body, a ferrofluid source, and a magnet, ferrofluid from the ferrofluid source into an annulus between the tool body and a wellbore formation;

magnetically couple the ferrofluid with the magnet; and arrange the ferrofluid to isolate at least one of an electrical contact or a sensor positioned in a wellbore from effects of fluids present in the wellbore by controlling at least one of the ferrofluid source or the magnet.

4. A downhole system, comprising:

a tool body;

a source of ferrofluid coupled with or in the tool body; and a magnet magnetically coupled with the ferrofluid from the source and positioned to arrange the ferrofluid adjacent to the tool body to isolate a sensor positioned on or in the tool body from effects of fluids present in a wellbore.

5. The downhole system of claim 4, wherein the tool body is positioned between a first downhole tool and a second downhole tool, wherein the magnet is positioned to arrange the ferrofluid to isolate the first downhole tool from signals transmitted from the second downhole tool through the fluids present in the wellbore.

6. The downhole system of claim 4, further comprising at least two ferrofluid isolators positioned along a face of the tool body such that the ferrofluid is retained in a shape protruding from the face between the at least two ferrofluid isolators.

7. The downhole system of claim 4, further comprising:

a first baffle positioned at a first end of the tool body;

a second baffle positioned at a second end of the tool body;

a sheltered region adjacent to the tool body and defined between the first baffle, the second baffle, the tool body, and a formation of the wellbore, wherein the first baffle and the second baffle are positioned to divert flow of wellbore fluid away from the sheltered region; and a passageway internal to the tool body and providing a flow path for the wellbore fluid diverted by the first baffle and the second baffle between the first end and the second end of the tool body, wherein the ferrofluid is positionable by the magnet within the sheltered region of the annulus.

8. The downhole system of claim 4, further comprising a ferrofluid collector positioned to collect the ferrofluid from adjacent to the tool body and convey the ferrofluid to the source of the ferrofluid.

9. The downhole system of claim 4, further comprising a system control center programmed with instructions to control at least one of the source of ferrofluid or the magnet in arranging the ferrofluid adjacent to the tool body by at least one of providing commands to the source to introduce the ferrofluid or providing commands to the magnet to magnetically couple with the ferrofluid.

10. The downhole system of claim 9, wherein the source is positioned to control a flow of the ferrofluid into a position adjacent to the tool body for magnetic coupling with the magnet.

11. A downhole system comprising:

a tool body;

a magnet coupled with or in the tool body; and a source of ferrofluid positioned to arrange the ferrofluid adjacent to the tool body by controlling a flow of ferrofluid into a position adjacent to the tool body at which the ferrofluid magnetically couples with the magnet to isolate at least one of an electrical contact or a sensor positioned in a wellbore from effects of fluids present in the wellbore.

12. The downhole system of claim 11, wherein the magnet includes at least two magnets arranged with poles of like polarity facing one another to magnetically couple with the ferrofluid to arrange the ferrofluid in a radially omnidirectional shape about an exterior portion of the tool body.

13. The downhole system of claim 11, wherein the source comprises a ferrofluid tank and a nozzle to convey a flow of ferrofluid from the ferrofluid tank to the position adjacent to the tool body, wherein the downhole system further comprises:

a ferrofluid collector positioned to collect the ferrofluid from the source in the position adjacent to the tool body and to convey collected ferrofluid to the ferrofluid tank; and a ferrofluid filter in fluid communication with the ferrofluid collector such that the ferrofluid filter reduces wellbore fluids conveyed to the ferrofluid tank by the ferrofluid collector.

14. The downhole system of claim 11, further comprising:

an upper ferrofluid isolator positioned along a face of the tool body and above the source of ferrofluid;

a lower ferrofluid isolator positioned along the face of the tool body and below the source of ferrofluid such that the ferrofluid is retained in a vertical region along the face of the tool body between the upper ferrofluid isolator and the lower ferrofluid isolator.

15. The downhole system of claim 11, further comprising:

a first ferrofluid isolator positioned laterally in a first direction from the source of ferrofluid along a face of the tool body;

a second ferrofluid isolator positioned laterally in a second direction from the source of ferrofluid along the face of the tool body such that the ferrofluid is retained in a lateral region along the face of the tool body between the first ferrofluid isolator and the second ferrofluid isolator.

16. The downhole system of claim 11, further comprising a system control center programmed with machine readable instructions to control at least one of the source of ferrofluid or the magnet in arranging the ferrofluid adjacent to the tool body by at least one of providing commands to the source to control the flow of ferrofluid or providing commands to the magnet to magnetically couple with the ferrofluid.

17. A system comprising:

a ferrofluid source positioned to introduce ferrofluid adjacent to a tool body;

a magnet magnetically coupled to the ferrofluid that is adjacent to the tool body; and a system control center programmed with machine readable instructions to:

arrange the ferrofluid to isolate at least one of an electrical contact or a sensor positioned in a wellbore from effects of fluids present in the wellbore by at least one of:

providing commands to the ferrofluid source to introduce the ferrofluid; or providing commands to the magnet to magnetically couple with the ferrofluid.

18. The system of claim 17, further comprising:

a magnetometer positioned to detect levels of ferrofluid from the ferrofluid source in the position adjacent to the tool body, wherein the system control center is programmed with instructions to arrange the ferrofluid at least in part based on the levels detected by the magnetometer.

19. The system of claim 17, further comprising a ferrofluid collector positioned to collect the ferrofluid from the ferrofluid source in the position adjacent to the tool body, wherein the system control center is programmed with instructions to control the magnet in arranging the ferrofluid such that the ferrofluid from the ferrofluid source in the position adjacent to the tool body is directed toward the ferrofluid collector.

* * * * *